US005193241A

United States Patent [19]

Meisingseth et al.

[11] Patent Number: 5,193,241

[45] Date of Patent: Mar. 16, 1993

[54] MACHINE FOR REMOVING SLAG AND METAL REMINDERS FROM CRUCIBLES

[75] Inventors: Leif Meisingseth; Jørn B. Lilleby, both of Sunndalsøra, Norway

[73] Assignee: Norsk Hydro A.S., Oslo, Norway

[21] Appl. No.: 704,967

[22] Filed: May 23, 1991

[30] Foreign Application Priority Data

May 23, 1990 [NO] Norway ..... 902275

[51] Int. Cl.[5] ..... B22D 43/00; B22D 41/04

[52] U.S. Cl. ..... 15/104.096; 15/93.1; 299/29; 299/55

[58] Field of Search ..... 15/104.1 C, 93.1, 93.2; 299/29, 34, 55, 56; 432/75; 134/8

[56] References Cited

U.S. PATENT DOCUMENTS 1,075,722 10/1913 Pauling ..... 15/104.1 C
1,145,927 7/1915 Shorten ..... 15/104.1 C
1,782,821 11/1930 Hechenbleikner ..... 15/104.1 C
3,082,454 3/1963 Spencer ..... 15/104.1 C
4,153,965 5/1979 Merly ..... 15/104.1 C

*Primary Examiner*—Edward L. Roberts
*Attorney, Agent, or Firm*—Wenderoth, Lind & Ponack

[57] ABSTRACT

A machine for removing slag and metal remainders from crucibles or casting ladles includes a frame on which is disposed a carriage movable in an upwardly inclined direction on guides or rails. The carriage is provided with cutter device having a tool head. A holder for a crucible is tiltable from a first position where the crucible can be placed on the holder to a second, operating position where the crucible is coaxial with the cutter device. The cutter is of the full profile type and is provided with a plurality of first tools which are spaced apart along the periphery of the tool head and second tools which are spaced apart in the radial direction on a front part of the tool head. The second tools are arranged so that the bottom of the crucible will be cleaned completely. The tool head is provided with axial through holes for the transportation therethrough of slag and metal remainders.

7 Claims, 3 Drawing Sheets

MACHINE FOR REMOVING SLAG AND METAL REMINDERS FROM CRUCIBLES

BACKGROUND OF THE INVENTION

The present invention relates to a machine for removing slag and metal remainders from casting ladles or crucibles. The machine includes a frame on which is provided a carriage with a rotating cutter means that is movable in an upwardly inclined direction. Means in association with the frame is provided for tilting a crucible from a lower loading position to an upper working position whereat the axis of the crucible is coaxial with the axis of the rotating cutter means tool.

Casting ladles or crucibles for molten metal will, after being used, have remainders of slag and metal left on their lining of refractory material. Such remainders have to be removed before the ladle can be used again.

Formerly, the ladles were cleaned manually by chipping or by machining with simple air driven machines, but such operation was hard, time consuming and damaging to the health of the workers. Besides, the refractory linings of the ladles often were damaged. The total costs of such manual cleaning were thus high. Later, mechanical devices have been developed, but many of these have not been commercially exploited.

U.S. Pat. Nos. 2,911,662 and 2,963,725, and NO Patent No. 147,940 all show devices for cleaning casting ladles or crucibles and having a movable rotating cutter head. A crucible to be cleaned is placed on a support having a direction of rotation which is opposite to that of the rotating cutter head, and the cutter head is provided in a position eccentric to the axis of the rotation of the crucible. The object with such arrangement is to ensure that all metal and slag remainders are removed from the bottom of the crucible. It is however a major disadvantage of such known devices that the tools are rapidly worn out. This in turn results in that the tools have to be exchanged after a relatively short period of time, e.g. 15–20 cleaned crucibles for each set of tools. Further, it is a disadvantage that such known devices are expensive, due to the fact that two different driving units are used, one for the cutter head and another for rotating of the crucible. Still further, it is a disadvantage with such known devices that they are of a construction having a relatively high height. Particularly, this is the case with the cleaning device according to NO Patent No. 147,940, where the construction height is more than two stories high and where the room in which the device is to be places has to be specially designed.

U.S. Pat. No. 4,153,965 discloses a cleaning device similar to those described above, but which is provided with a "full profile" cutter head and where the crucible is held in a stationary position. By the term "full profile" is meant that the diameter of the cutter head corresponds to the inner diameter of the crucible. The cutter head is provided with three tools or shears spaced peripherally of the cutter head. In addition, the cutter head is provided with a separate cutter unit which has for its object to clean the bottom of the crucible completely. The separate cutter unit is eccentrically disposed relative to the cutter head axis and is driven via a planetary gear. It is a major disadvantage with this known device that it is complicated and mechanically weak in relation to the great strain to which it is exposed during a cleaning operation, and this may well be one of the reasons why it is not commercially exploited. A further disadvantage of such device is the high construction height that is due to the steep inclination angle of the rotating cutter means.

SUMMARY OF THE INVENTION

It is an object of the present invention to provide a machine for cleaning crucibles and which is more simple and less costly than known devices.

It is a further object of the invention to provide such a machine for cleaning crucibles and which has sufficiently low weight and low construction height that it can be employed in rooms not specially designed for such machine.

It is a still further object of the invention to make such machine reliable and wear resistant to avoid down time and reduce maintenance costs.

According to the invention, there is provided a machine of the type mentioned above, but wherein the cutter means, which is of the full profile type, is equipped with a plurality of first tools provided at the periphery of a cutter head and a plurality of second tools spaced apart in the radial direction of the cutter head, which tools are arranged such that the wall as well as the bottom of the crucible are cleaned completely, and the cutter head between the tools is provided with through openings extending in the axial direction of the cutter head.

By the provision of plurality of first and second tools, an effective cleaning of the crucible is achieved, and the load or strain on each of the tools is relatively low. This in turn reduces the wear of the tools. Thus, in connection with testing of the machine, it has been revealed that the useful life of the tools is equivalent to the cleaning of 1000 crucibles or ladles. This results in maintenance costs being reduced substantially.

The through openings in the cutter head are necessary to enable the slag and metal remainders being scraped off by the tools to be transported rearwardly and out of the crucible.

According to a preferred embodiment of the invention, the cutter head may be provided with screw threads directly behind the tools, whereby the slag and metal remainders are more effectively transported out of the crucible. Thereby, the inclination angle of the cutter head may be reduced, and the construction height of the machine correspondingly lowered.

BRIEF DESCRIPTION OF THE DRAWINGS

The invention will now be further described by way of example only and with reference to the accompanying drawings, in which.

DETAILED DESCRIPTION OF THE INVENTION

Figure 1:
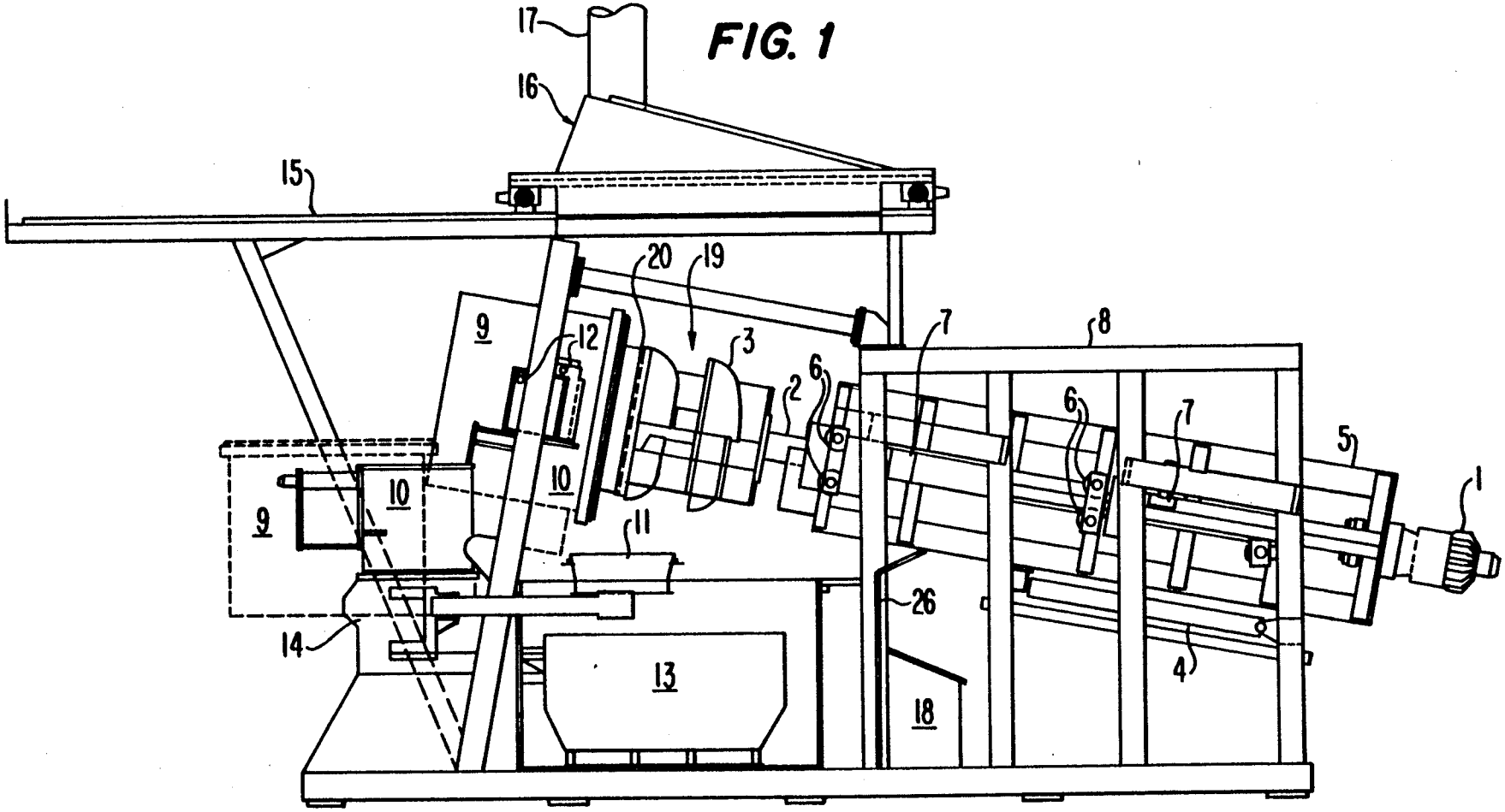
FIG. 1 is a longitudinal view of a machine according to the invention.

The machine according to the invention comprises, as shown in FIG. 1, three main components, namely a frame 8, a carriage or slide 5 with cutter means 19, and means 10 for holding and tilting a crucible or a casting ladle 9. The cutter means 19 is fixed to a shaft 2 which is provided on carriage 5. The shaft is driven by a hydraulic motor 1. Further, the carriage 5 is slidably mounted on the frame 8 by means of solid wheel guides 6, 7 disposed on each side of the frame 8.

A ram 4 is provided to move the carriage 5 in opposite directions. The cutter means 19 comprises a leading cutter head 20 and a trailing conveying screw portion 3. The carriage 5 with the cutter means 19 is arranged inclined at an angle relative to the frame 8. This is done to more easily transport slag and metal remainders from a crucible in connection with a cleaning operation thereof.

The holder means 10 for the crucible 9 is tiltably provided at the front end of the frame 8 by means of a ram 14. The tiltable holder means 10 can be tilted from a loading/disloading position, where a crucible 9 (dotted lines) can be placed on or removed from the holder means 10, to an operating position (solid lines) where the axis of the crucible 9 is coaxial with the axis of the cutter head 20. The crucible 9 is firmly held in its operating position by means of locking pins 12.

In conjunction with the holder means 10 is provided a support for a mold 11. In situations where warm crucibles are cleaned, the mold 11 can be moved under the crucible as shown in FIG. 1, such that any remaining molten metal in the crucible may be discharged into the mold before the cleaning operation is started. Under the mold 11 is provided a container 13 for collecting slag and metal remainders scraped out of the crucible.

Above the cutter means 19 is provided a suction cover 16 which is connected to an air suction pipe 17. The suction cover 16 can be moved sideways along rails 15 in connection with maintenance of the cutter means. The space under the cover 16 may be wholly or partly enclosed to reduce or eliminate the escape of dust.

Figure 2:
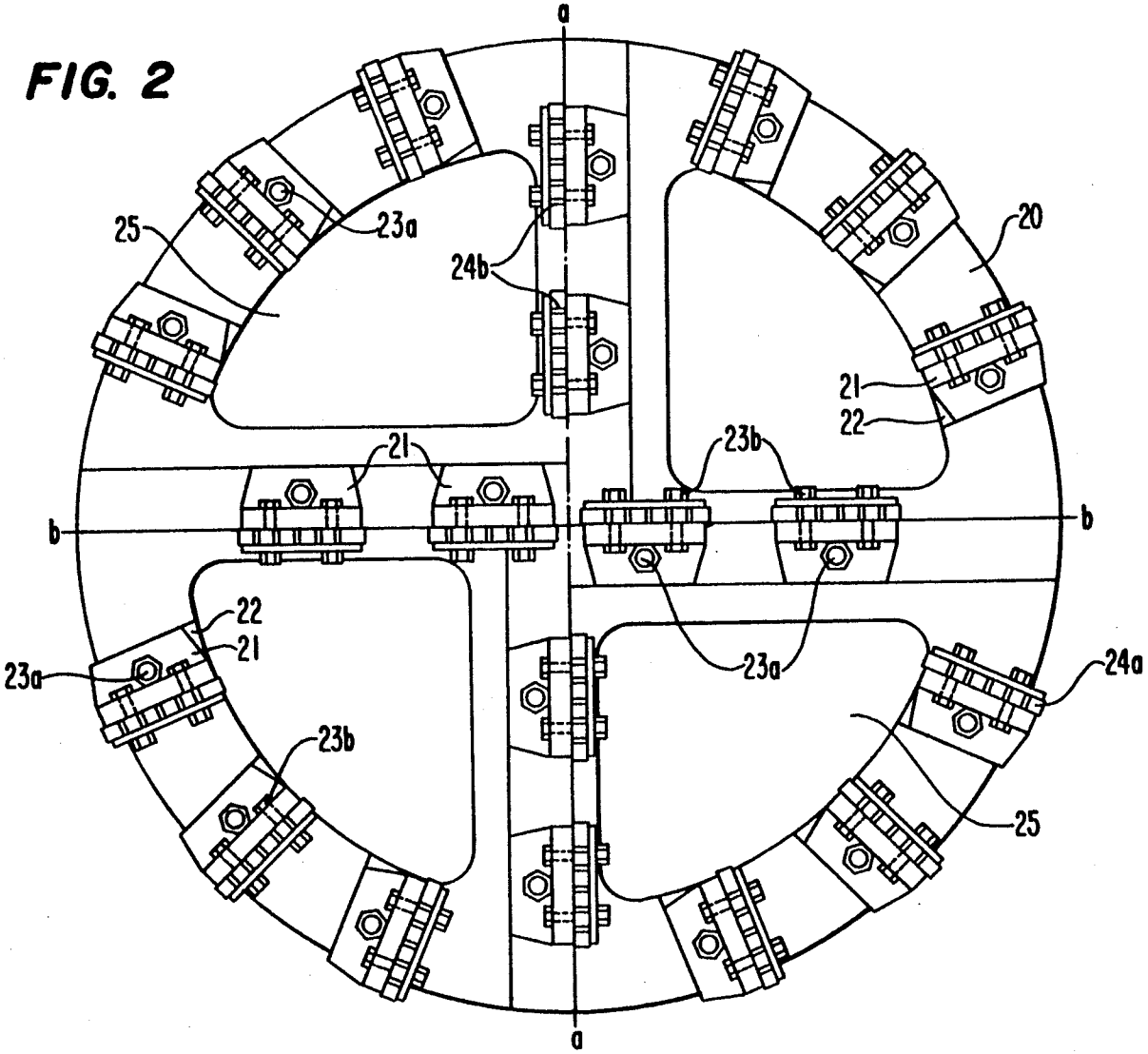
FIG. 2 is a front view of a cutter head for the machine and shown at an enlarged scale.

The cutter head 20 for the cutter means 19 is further shown in FIG. 2 on a larger scale and includes a plurality of tool holders 21 which are fixedly attached in grooves 22 in the cutter head by means of bolts 23*a*. To each tool holder 21 is releasably attached a tool or shear 24*a* or 24*b* by means of second bolts 23*b*. In the embodiment shown in FIG. 2, there is provided a plurality of first tools 24*a* (totally twelve) along the periphery of the cutter head and a plurality of second tools 24*b* (totally eight) positioned diametrically across the cutter head along diametral lines a—a and b—b. The tools 24*a*, 24*b* are so arranged and spaced apart from one another that the entire bottom of a crucible will be cleaned during a cleaning operation. Between the tools 24*a*, 24*b* are provided through holes 25 through which slag and metal remainders scraped from a crucible being cleaned can be transported rearwardly and out of the crucible. The screw portion 3 of the cutter means (see FIG. 1) removes the remainders more effectively.

Figure 3:
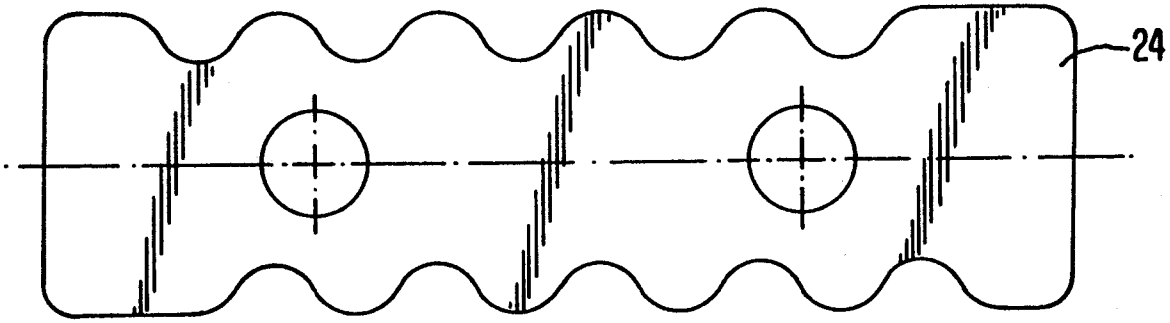
FIG. 3 is an elevation view of a tool for the cutter head shown in FIG. 2.

FIG. 3 shows an example of a specific tool design according to the invention. As will be apparent, the edge on each side of the tool 24 has a sinusoidal configuration. The object with such configuration is to reduce the strain on the tool during a cleaning operation. Further, this design makes it possible to turn the tool so that each side thereof may be used. Thereby, the useful life of the tool can be prolonged substantially.

The machine according to the invention functions as follows. A crucible 9 is transported by means of a truck and is placed on the holder means 10 that is in its loading position. The holder means 10 thereafter is tilted by means of ram 14 to its upper, operating position where the axis of the crucible is in co-alignment with the axis of the cutter head 20. The crucible is warm as it just has been used, and any remaining molten metal is discharged to the mold 11 which has been moved to a position shown in FIG. 1. When there is no more molten metal in the crucible, the mold is moved sideways, and locking pins 12 (two on each side) hold the crucible firmly in position. The cutter means 19 now can be started by an operator. As it begins to rotate, the ram 4 simultaneously moves the carriage 5 with the cutter means 19 towards the crucible. If the resistance or rather the forces acting on the cutter head 20 exceed a predetermined level, the hydraulic pressure for the cutter head motor is reduced automatically towards zero, and the carriage 15 with the cutter means 19 is pulled back to its initial position. Thereby, breakage of the cutter means is avoided.

Normally, the cleaning operation will take 3–6 minutes, and the cutter means is returned to its initial position. Slag and metal remainders scraped from the wall and bottom of the crucible are forced out through the holes 25 in the cutter head 20, via the screw portion 3 and discharged into the container 13. After the cleaning operation has been terminated, the locking pins 12 are released, and the holder means 10 is returned back to its initial position.

The cleaning operation is completely controlled by means of an electronic, logic control. There is provided a platform 18 with a shield 26 for an operator who stops and starts the machine.

The machine according to the invention was initially designed to clean hot crucibles for aluminum metal. It has, however, been proved that the machine may also be used for removing slag and metal remainders from cold crucibles as well as crucibles for other metals.

We claim:

1. A machine for cleaning and removing slag and metal remainders from a crucible or casting ladle, said machine comprising:

a frame;

a carriage mounted on said frame and guided for movement relative thereto in an upwardly inclined direction;

a rotatable cutter means having a tool head and mounted on said carriage for movement therewith in said direction;

holder means for supporting a crucible to be cleaned, said holder means being mounted for tilting movement between a first position, whereat a crucible to be cleaned may be placed on said holder means, and an operating second position, whereat a crucible to be cleaned and supported by said holder means is in coaxial alignment with said cutter means;

tools mounted on said tool head such that rotation of said cutter means and movement of said carriage and said cutter means in said direction toward a crucible to be cleaned will result in said tools cleaning a full interior of the crucible, said tools comprising a first plurality of tools mounted in spaced relationship along a periphery of said tool head, thereby to clean slag and metal remainders from a side wall of the crucible, and a second plurality of tools fixedly mounted on a leading portion of said tool head, relative to said direction, in a radially spaced arrangement to insure cleaning of slag and metal remainders from an entire bottom wall of the crucible; and said tool head having extending therethrough axial through holes providing access for slag and metal remainders removed by said tools to be transported axially away from the crucible.

2. A machine as claimed in claim 1, wherein said cutter means includes, at a position rearwardly of said tool head, screw means for assisting in transporting removed slag and metal remainders away from the crucible.

3. A machine as claimed in claim 1, wherein said second plurality of tools are arranged in a plurality of lines extending diametrically of said tool head.

4. A machine as claimed in claim 3, wherein said second plurality of tools are arranged in two said lines extending perpendicularly to each other.

5. A machine as claimed in claim 1, wherein each said tool is flat.

6. A machine as claimed in claim 5, wherein said flat tool has a sinusoidal cutting edge.

7. A machine as claimed in claim 6, wherein said tool has oppositely spaced sinusoidal cutting edges.

* * * * *